United States Patent [19]

Fujishiro

[11] 4,120,269

[45] Oct. 17, 1978

[54] COMPENSATION FOR INHERENT FLUCTUATION IN OUTPUT LEVEL OF EXHAUST SENSOR IN AIR-FUEL RATIO CONTROL SYSTEM FOR INTERNAL COMBUSTION ENGINE

[75] Inventor: Takeshi Fujishiro, Yokohama, Japan

[73] Assignee: Nissan Motor Company, Limited, Yokohama, Japan

[21] Appl. No.: 715,652

[22] Filed: Aug. 19, 1976

[30] Foreign Application Priority Data

Sep. 30, 1975 [JP] Japan ..... 50-117244
Dec. 13, 1975 [JP] Japan ..... 50-167488[U]

[51] Int. Cl.[2] ..... F02B 3/00
[52] U.S. Cl. ..... 123/32 EE; 123/119 EC

[58] Field of Search ..... 123/32 EE, 119 EC; 60/276, 285

[56] References Cited

U.S. PATENT DOCUMENTS 3,973,529 10/1976 Wessel et al. ..... 123/32 EE

*Primary Examiner*—Samuel Feinberg
*Attorney, Agent, or Firm*—Lowe, King, Price & Becker

[57] ABSTRACT

In a feedback control system for maintaining the air-fuel ratio of a combustible mixture fed to an internal combustion engine at a preset ratio, a fluctuation in the output characteristic of an exhaust sensor due to deterioration or low temperature is compensated for by varying a reference voltage, which serves as a standard of comparison, in response to a change in a maximal value of the sensor output voltage.

8 Claims, 7 Drawing Figures

COMPENSATION FOR INHERENT FLUCTUATION IN OUTPUT LEVEL OF EXHAUST SENSOR IN AIR-FUEL RATIO CONTROL SYSTEM FOR INTERNAL COMBUSTION ENGINE

This invention relates to a feedback control system for maintaining the air-fuel ratio of a combustible mixture fed to an internal combustion engine at a preset ratio, which system is of the type having an exhaust sensor for estimating a realized air-fuel ratio, and more particularly to a method of compensating for an inherent fluctuation in the output characteristic of the exhaust sensor by establishing a reference input signal in the feedback control system, the amplitude of which reference signal is variable according to a change in the output characteristic of the exhaust sensor, and an electrical circuit for accomplishing the method.

In internal combustion engines, it is important for the reduction of the concentration of pollutants in the exhaust gas to maintain the air-fuel ratio of a combustible mixture fed to the engine exactly at an optimumly preset ratio. As is well known, the air-fuel ratio realized in the engine can be estimated by detecting the concentration of a certain component of the exhaust gas (which may be $O_2$, CO, $CO_2$, HC or NOx), and various types of exhaust sensors for this use are now available. In known feedback control systems for precisely controlling the air-fuel ratio, a control signal for regulating either the fuel feed rate or the air feed rate in an air-fuel proportioning device, for example a carburetor or a fuel injection system; is typically produced in the following manner. Any deviation of the output of an exhaust sensor from a preset reference signal (which corresponds to the preset air-fuel ratio) is detected in a deviation detection circuit (for example, a differential amplifier or a comparator), and the control signal is produced by either multiplying or integrating the detected deviation, or alternatively by the addition of the multiplied deviation (a proportional component of the control signal) to the integrated deviation (integral component).

The control signal is produced in the above described manner on the premise that the output of the exhaust sensor has a definite correlation with the air-fuel ratio of the combustible mixture consumed in the engine. However, practical exhaust sensors inevitably exhibit changes in their output characteristic when exposed to various temperatures and/or used for a long period of time, because the exhaust sensors have either a semiconductor or an electrolyte as the sensing element. When the relationship between the air-fuel ratio of the combustible mixture and the output of the exhaust sensor is different from a preliminarily calibrated one while the reference signal is maintained constant, the application of the control signal to the air-fuel proportioning device results in the regulation of the air-fuel ratio to a ratio unwantedly deviated from the preset ratio.

With respect to a feedback control system for maintaining the air-fuel ratio of a combustible mixture fed to an internal combustion engine to a preset ratio, which system includes an exhaust sensor capable of producing an electrical output representing the concentration of a component of the exhaust gas which concentration is correlated to the air-fuel ratio realized in the engine, it is an object of the present invention to provide a method of compensating for an inherent fluctuation in the output characteristic of the exhaust sensor by establishing a reference signal, which reference signal serves as a standard of comparison in detecting any deviation of the amplitude of the output of the sensor from an expected amplitude corresponding to the preset air-fuel ratio and automatically fluctuates in its amplitude in response to a change in the relationship between the aforementioned concentration and the amplitude of the output of the exhaust sensor.

It is another object of the invention to provide an electrical circuit as part of the above described feedback control system for establishing a reference signal according to a method of the invention.

According to a method of the invention, an inherent fluctuation of the output characteristic of the exhaust sensor is compensated for by varying the reference voltage in response to and in a definite correlation with a change in a maximal value of the output voltage of the exhaust sensor.

The reference voltage can be varied by continuously applying the output voltage of the exhaust sensor to a maximal input retention circuit having a capacitor and a voltage divider which is adjusted such that the reference voltage is continuously in a definite proportion to a maximal value of the output voltage of the exhaust sensor. Alternatively, the reference voltage is varied stepwise by varying the resistance of a resistor for developing the reference voltage when a comparator detects that the maximal value of the output voltage of the exhaust sensor has lowered to a predetermined voltage.

A variable reference voltage producing circuit according to the invention has a capacitor to which the output voltage of the exhaust sensor is continuously applied through a diode, preferably with the provision of a preamplifier for providing a high input impedance to the circuit, and a voltage divider in parallel with the capacitor. The proportion of the reference voltage to the maximal value of the output voltage of the exhaust sensor can be determined by the adjustment of the voltage divider. When the exhaust sensor is of the type which exhibits a great lowering in the maximal value of the output voltage at low temperatures, the reference voltage producing circuit preferably includes an auxiliary circuit which continuously produces a constant voltage below the maximum value of the output of the voltage divider so that the constant voltage may serve as the reference voltage when the output of the voltage divider is below the constant voltage.

A circuit for varying the reference voltage stepwise has a first circuit having a voltage divider for producing the reference voltage which alternatively has two different magnitudes, a switching circuit including a flip-flop for governing the resistance of the voltage divider, a comparator for maintaining the switching circuit and the voltage divider in a first state when the maximal value of the output of the exhaust sensor is above a predetermined voltage, a second circuit having a capacitor which also receives the output of the comparator and a resistance, and another comparator the output of which causes the flip-flop to take a second state and shifts the reference voltage to a lower magnitude when the output voltage of the second circuit lowers to a predetermined voltage.

The invention will fully be understood from the following detailed description of preferred embodiments with reference to the accompanying drawings, wherein.

Figure 1:
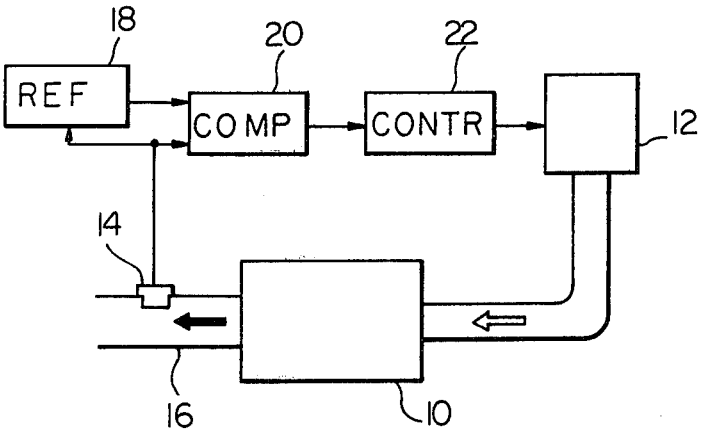
FIG. 1 is a block diagram of an air-fuel ratio control system in an internal combustion engine.

With respect to an internal combustion engine indicated at 10 in FIG. 1, an air-fuel ratio control system, which is the object of the invention, includes a controllable air-fuel proportioning device 12 exemplified by a carburetor or a fuel injection system, an exhaust sensor 14 installed in the exhaust line 16 of the engine 10, an electrical circuit 18 for producing a reference signal, another electrical circuit 20 exemplified by a differential amplifier or a comparator arranged to receive the output of the exhaust sensor 14 and the reference signal and produce an output signal representing the magnitude of the deviation of the output of the exhaust sensor 14 from the reference signal, and a control circuit 22 which produces a control signal for the control of the air-fuel proportioning device 12 by modulating the output signal of the comparison circuit 20 in a manner as hereinbefore described. In conventional air-fuel ratio control systems of the illustrated type, the circuit 18 has merely the function of providing a constant reference voltage to the comparison circuit 20, so that the output of the exhaust sensor 14 is not applied to this circuit. According to the invention, the output of the exhaust sensor 14 is applied to both the comparison circuit 20 and the reference signal producing circuit 18 as will hereinafter be described in detail.

At present, a most familiar example of the exhaust sensor 14 is an oxygen sensor which is essentially an oxygen concentration cell having a solid electrolyte, for example, of a stabilized zirconia system. When such an oxygen sensor is used as the exhaust sensor 14 in the control system of FIG. 1 and the engine 10 is a gasoline engine, the output voltage of the oxygen sensor varies as represented by the curve (A) in FIG. 2 as the air-fuel ratio (by weight) of the combustible mixture consumed in the engine 10 varies. In many cases, the control system will be adjusted to maintain the air-fuel (gasoline) ratio at the stoichiometric ratio which is about 14.8. Since the output voltage of the oxygen sensor is 0.5 V when the air-fuel ratio is 14.8, a 0.5 V signal may constantly be applied to the comparison circuit 20 in order to correct any deviation of the air-fuel ratio from 14.8.

However, the output characteristic of the oxygen sensor shifts from the curve (A) to a different curve (B) when the sensor is exposed to the exhaust gas for a prolonged period of time. On the curve (B), the output voltage for air-fuel ratios below a point near the stoichiometric ratio is lower than that of the curve (A). A similar lowering of the output voltage occurs also when the oygen sensor is used at relatively low temperatures because of a noticeable increase in the internal resistance of the sensor or concentration cell. If the amplitude of the reference signal is kept at 0.5 V even though the output characteristic of the oxygen sensor has varied as represented by the curve (B), the air-fuel ratio control system fails to maintain the air-fuel ratio at 14.8 as intended: the air-fuel ratio is regulated to a lower ratio indicated at *x* in FIG. 2.

Figure 2:
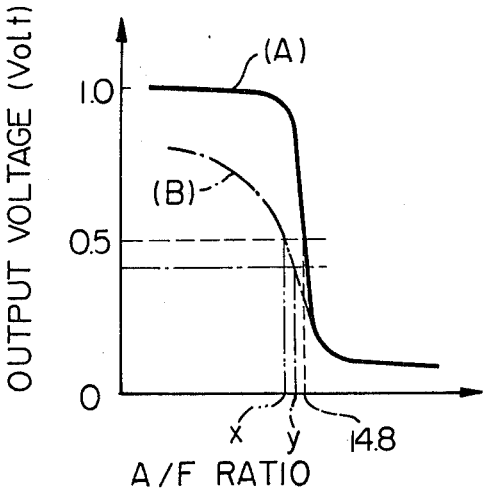
FIG. 2 is a graph showing the output characteristic of a conventional oxygen sensor employed as the exhaust sensor in the control system of FIG. 1 for the explanation of the influence of a fluctuation in the output characteristic and a variation in the amplitude of a reference signal on the control of the air-fuel ratio.

According to the invention, the reference signal is not a constant voltage signal but a variable voltage signal whose amplitude has a definite relation with a maximal value of the output of the exhaust sensor 14. With respect to the oxygen sensor having an output characteristic as shown in FIG. 2, the maximal value of the output is about 1.0 V when the sensor is used in an optimum state. If the reference signal is produced to always have an amplitude equal to ½ of the maximal value of the output of this oxygen sensor, the air-fuel ratio can be regulated to 14.8 while the output characteristic of the oxygen sensor is as represented by the curve (A). When the output characteristic of the oxygen sensor is a represented by the curve (B) (the maximal value has lowered from about 1.0 V to about 0.8 V), the amplitude of the reference signal lowers from 0.5 V to about 0.4 V. As the result, the air-fuel ratio is regulated to a ratio *y* which is closer to 14.8 than the ratio *x* is. Since the relationship between a maximal value of the output of the exhaust sensor 14 and the amplitude of the reference signal can optionally be determined, it is possible to make the ratio *y* closer to the intended air-fuel ratio (14.8) than as is illustrated. Alternatively, the amplitude of the reference signal may be varied in dependence on the mean value of maximal and minimal values of the output of the exhaust sensor 14 as will be illustrated later.

Figure 3:
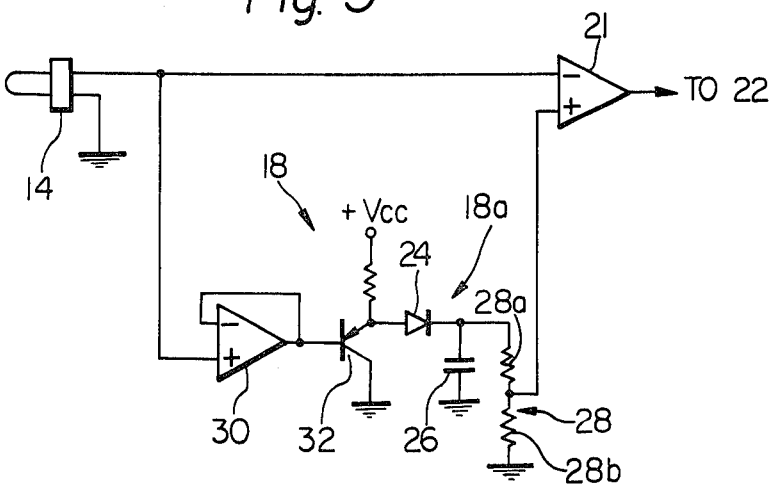
FIG. 3 is a diagram of a circuit for producing a variable reference signal as an embodiment of the invention.

FIG. 3 shows an example of the construction of the circuit 18 for producing a variable reference signal in the case when it is intended to continuously vary the amplitude of the reference signal with a change in a maximal value of the exhaust sensor 14.

The output of the exhaust sensor 14, for example an oxygen sensor of the above described type, is applied to both the negative input terminal of a comparator 21 (which serves as the comparison circuit 20 in FIG. 1) and the reference signal producing circuit 18. This circuit includes a maximal input retention circuit **18*a* which is fundamentally constituted of a diode 24, a capacitor 26 and a voltage divider 28 having two resistors 28*a* and 28*b* in parallel with the capacitor 26. In addition, an operational amplifier 30 of the voltage follower connection type is included as the entrance to this circuit 18 to provide a high input impedance to this circuit 18 so that the output of the exhaust sensor 14 may be applied to the comparator 21 without being influenced by the circuit 18. The output of the operational amplifier 30 is applied to the diode 24 via a transistor 32 which is employed as a temperature compensation means for the diode 24**.

The retention circuit **18*a* in the circuit 18 of FIG. 3 can retain a maximal value of an input (in this case the output of the exhaust sensor 14) and provide an output whose amplitude is in definite proportion to the maximal value of the input. The proportion of the amplitude of the output of the circuit 18 to the maximal value of the input is determined by the ratio of the resistance $R_1$ of the resistor 28*a* to the resistance $R_2$ of the resistor 28*b*. The output of the circuit 18 has an amplitude equal to ½ of the maximal value of the input when $R_1 = R_2$. The output of the circuit 18 is applied to the positive input terminal of the comparator 21 as a reference signal, so that any fluctuation in the maximal value of the output of the exhaust sensor 14** can be compensated for to a desired extent by a simultaneous fluctuation in the amplitude of the reference signal.

It will be apparent that the voltage divider 28 may be replaced by a variable resistor (not shown).

Figure 4:
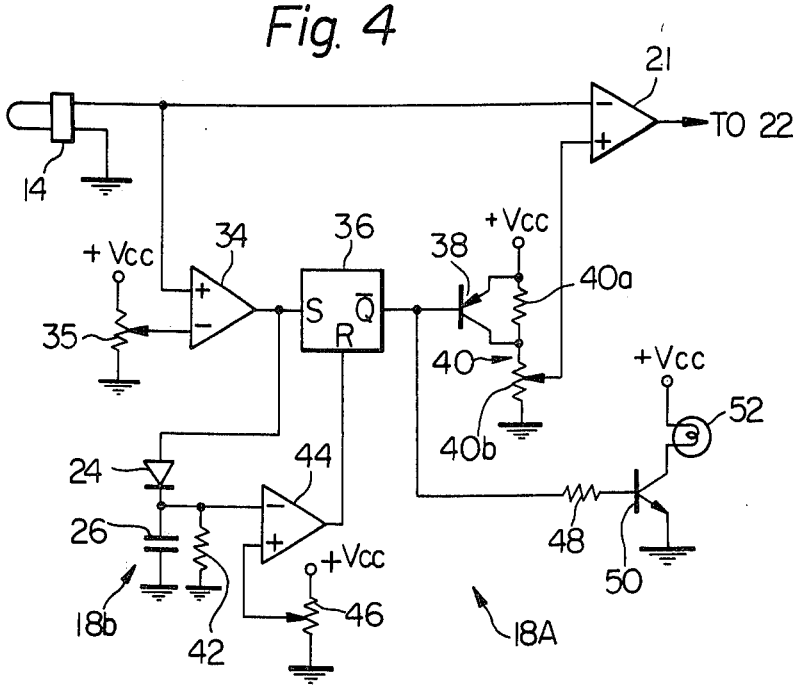
FIGS. 4, 5 and 7 are diagrams of three differently constructed circuits for the same purpose as further embodiments of the invention.

FIG. 4 shows a different construction of the reference signal producing a circuit 18. The amplitude of a reference signal produced by this circuit 18A varies stepwise when the maximal value of the exhaust sensor 14 fluctuates to a certain extent.

The circuit 18A has a first comparator 34. The output of the exhaust sensor 14 is applied not only to the negative input terminal of the comparator 21 but also to the positive input terminal of this comparator 34. As a standard of comparison, a constant reference voltage, which is developed by impressing a constant voltage Vcc on a resistor 35, is applied to the negative input terminal of the first comparator 34. This reference voltage is lower than the maximal value of the output of the exhaust sensor 14 in a normal or optimum state: for example, 70% of the maximal value. A voltage divider 40 of the circuit 18A has two resistors **40*a* and 40*b* and is imposed with the constant voltage $V_{cc}$ to provide an output voltage as a reference signal to the comparator 21. A transistor 38 is connected in parallel with one (40*a*) of the two resistors 40*a* and 40*b* so that the connected resistor 40*a* may be by-passed when the transistor 38 is in the conducting state. A flip-flop 36 is arranged to receive the output of the first comparator 34 and apply its $\overline{Q}$ output to the base of the transistor 38. When the exhaust sensor 14 exhibits a normal output characteristic (the maximal value of the output is greater than the reference voltage provided by the resistor 36), the output of the first comparator 34 takes the form of a logic "1" signal. Accordingly, the flip-flop 36 is in the set state, so that the $\overline{Q}$ output is a "0" signal. In this state, the transistor 38 is in the conducting state and makes the resistor 40*a* ineffectual. The reference signal developed by the voltage divider 40**, therefore, has a higher one of two alternatively realizable levels of amplitudes: for example, the amplitude of the reference signal in this state may be 0.5 V with respect to the above described oxygen sensor.

The circuit 18A has a retention circuit **18*b* which consists of the diode 24, capacitor 26 and a resistor 42 in parallel with the capacitor 26. The output of the first comparator 34 is applied also to this retention circuit 18*b*, and the output of the retention circuit 18*b* is applied to the negative input terminal of a second comparator 44. The constant voltage $V_{cc}$ is imposed on a resistor 46 to develop a constant reference voltage, which is below the maximal value of the output voltage of the exhaust sensor 14 and is applied to the positive input terminal of the second comparator 44. The output of the second comparator 44 is applied to the flip-flop 36 so that the flip-flop 36 may be reset when the second comparator 44 provides an "1" output signal. While the output voltage of the retention circuit 18*b* is higher than the reference voltage developed across the resistor 46, the second comparator 44 provides a "0" output signal. Accordingly, the flip-flop 36 remains in the set state and the reference signal produced by the voltage divider 40 is kept at the higher level even if the exhaust sensor 14** exhibits a slight lowering in the maximal value of its output.

When the maximal value of the output of the exhaust sensor 14 becomes below the reference voltage produced by the resistor 36, the first comparator 34 continuously provides a "0" output signal. If the retention circuit **18*b* continues to receive the "0" output signal from the first comparator 34 for a certain period of time, the output voltage of the retention circuit 18*b* becomes below the reference voltage produced by the resistor 46 due to discharge of the electric charge stored in the capacitor 26. Then the second comparator 44 produces an "1" output signal and the flip-flop 36 is reset. Accordingly the $\overline{Q}$ output of the flip-flop 36 becomes an "1" signal and the transistor 38 is cut off. Consequently the amplitude of the reference signal produced by the voltage divider 40 falls to a lower level (for example, 0.35 V compared with the higher level of 0.5 V) determined buy the two resistors 40*a* and 40*b***.

The circuit 18A preferably includes a warning circuit consisting of a resistor 48, a transistor 50 and an indicator lamp 52. The $\overline{Q}$ output of the flip-flop 36 is applied to the base of the transistor 50 through the resistor 48. Accordingly the transistor 50 is in the conducting state and the lamp 52 is lighted when the $\overline{Q}$ output is an "1" signal, i.e. when the lowering of the output of the exhaust sensor 14 is more than tolerable.

By applying a variable magnitude reference signal produced by the above described method to the comparator 21 or the comparison circuit 20 in FIG. 1, it is possible to accomplish a precise control of the air-fuel ratio by means of a control system constructed generally as shown in FIG. 1 even though the exhaust sensor 14 is either deteriorated to a certain extent by lapse of time or exposed to a low temperature exhaust gas.

If the exhaust sensor 14 is a conventional oxygen sensor when the amplitude of the reference signal is allowed to continuously vary as described with reference to FIG. 3, there is a problem that the reference signal will have an extremely low amplitude when the exhaust gas temperature is very low as experienced at cold starting of the engine 10. This problem arises from the fact that conventional oxygen sensors have a very high internal impedance unless maintained at sufficiently high temperatures. Besides, the comparison circuit 20 generally has a very high input impedance (usually on the order of megohm) and is connected to the exhaust sensor 14 (oxygen sensor) with a harness of a considerable length. Accordingly the comparison circuit 20 chances to make a malfunction attributable to a noise, resulting in the instability of the air-fuel ratio, when the reference signal is of an extremely low amplitude. The reference signal producing circuit 18, therefore, preferably includes a circuit for holding the amplitude of the reference signal at a definite value while the maximal value of the output of the exhaust sensor 14 is below a predetermined value.

Figure 5:
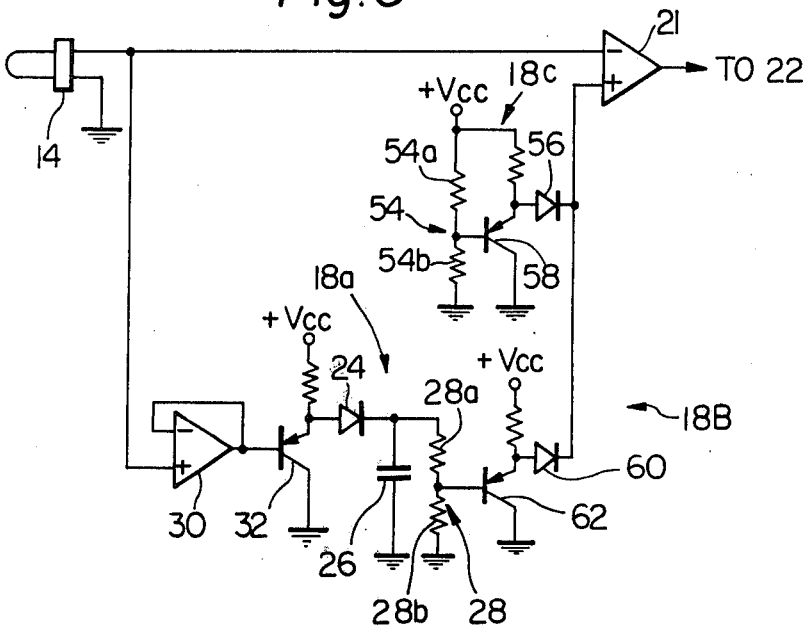

A circuit 18B of FIG. 5 has the maximal input retention circuit **18*a* shown in FIG. 3 and, in addition, a minimal output holding circuit 18*c*. This circuit 18*c* consists of a voltage divider 54 having two resistors 54*a* and 54*b*, a diode 56 through which the output of the voltage divider 54 can be applied to the positive input terminal of the comparator 21, and a transistor 58 arranged to serve as a temperature compensation means for the diode 56. The constant voltage $V_{cc}$ is imposed on the voltage divider 54, so that the output of this circuit 18*c* has a definite amplitude determined by the resistances of the two resistors 54*a* and 54*b*. The output of the maximal input retention circuit 18*a* is applicable to the positive input terminal of the comparator 21 through a diode 60, and a transistor 62 is provided as a temperature compensation means for this diode 60**.

Figure 6:
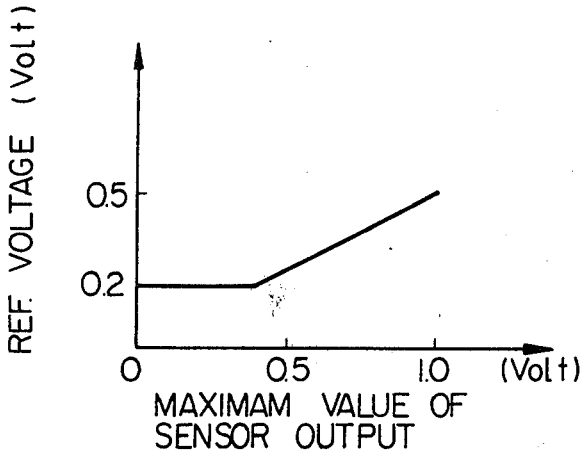
FIG. 6 is a graph showing the relationship between the output characteristic of an oxygen sensor connected to the circuit of FIG. 5 and the amplitude of the reference signal produced by the same circuit.

In the circuit 18B of FIG. 5, the function of the maximal input retention circuit **18*a* is the same as in the case of FIG. 3. For example, the circuit 18*a* and accordingly the circuit 18B provide a reference signal which is always 50% in amplitude of the output of the oxygen sensor 14 so long as the reference signal has an amplitude greater than the amplitude of the constant output of the circuit 18c. When the maximal value of the output of the oxygen sensor 14 is extremely low, for example less than 50% of the value in normal state, the amplitude of the output of the circuit 18B (the reference signal applied to the comparator 21) lowers no more but is held at the output voltage of the minimal output retention circuit 18c. FIG. 6 shows the relationship between the maximal output voltage of the oxygen sensor 14 having the output characteristic of FIG. 2 and the amplitude of the reference signal produced by the circuit 18B, assuming that the output voltage of the maximal input retention circuit 18a is 50% of the maximal value of the output of the oxygen sensor 14 and that the minimal output retention circuit 18b** produces a constant voltage of 0.2 V.

Thus, the provision of the minimal output retention circuit 18b in the circuit 18B prevents the control system of FIG. 1 from errorneously functioning by the influence of a noise even when the maximal value of the output of the oxygen sensor 14 is extremely low. The circuit 18B has an additional advantage with respect to the operation of the engine 10 at low engine temperatures. It is desirable to temporarily feed the engine 10 with a slightly fuel-enriched mixture (lower the air-fuel ratio) for securing the stability of the engine operation when the engine temperature is very low as in the case of cold starting of the engine 10, but the output voltage of the oxygen sensor 14 under such a low temperature condition is almost zero due to a great internal resistance and does not cause the air-fuel ratio control system to so act as to lower the air-fuel ratio. The minimal output retention circuit 18c, however, provides the low voltage reference signal in this case and causes the control system to lower the air-fuel ratio until the engine temperature of exhaust temperature rises to a sufficiently high level.

Figure 7:
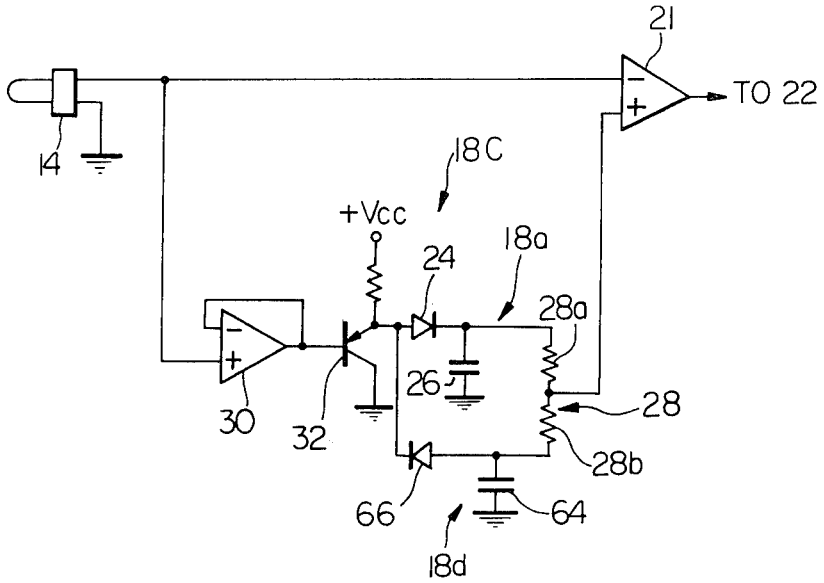

A change in the output characteristic of the exhaust sensor 14 usually occurs as a lowering of a maximal value of the output voltage while a minimal value remains substantially unchanged, and in many cases the reference voltage for the comparison circuit 20 is preset around the middle of the total range of the output voltage of the exhaust sensor 14. Accordingly the reference voltage may be varied in dependence on the mean value of maximal and minimal values of the output voltage of the exhaust sensor 14. FIG. 7 shows a modification of the circuit of FIG. 3 to take the mean value as the indication of the output characteristic of the exhaust sensor 14. This circuit 18C includes all the elements of the circuit 18 of FIG. 3. In addition, a capacitor 64 is interposed between the voltage divider 28 and ground, and a diode 66 is connected to the voltage divider 28 in parallel with this capacitor 64. The cathode of this diode 66 is connected to the junction between the transistor 32 and the anode of the diode 24. Accordingly the transistor 32 serves as temperature compensation means for both the diodes 24 and 66. The voltage divider 28 (which is an element of the maximal value retention circuit 18a), the capacitor 64 and the diode 66 constitute a minimal value retention circuit 18d. The output of this circuit 18C has a variable amplitude in proportion to the mean value of the maximal and minimal values of the input signal amplitude by making the resistances of the two resistors 28a and 28b nearly equal.

What is claimed is:

1. In a feedback control system for maintaining the airfuel ratio of a combustion mixture feed to an internal combustion engine, the system including an exhaust sensor which is installed in the exhaust line of the engine and produces an output voltage representing the concentration of a definite component of the exhaust gas of the engine, the concentration being in dependence on the airfuel ratio of the combustible mixture consumed in the engine, a comparison circuit to detect the magnitude of a deviation of the output voltage of the exhaust sensor from a reference voltage and a control circuit to control the function of the air-fuel proportioning device based upon the detected magnitude of the deviation, a circuit for producing the reference signal comprising:

a first capacitor connected to the exhaust sensor to continuously receive the output voltage of the exhaust sensor, and a voltage divider connected in parallel with said first capacitor, said voltage divider being adjusted such that the output voltage of said voltage divider is continuously below and in a definite proportion to the maximal value of the output voltage of said exhaust sensor; and a second capacitor connected in parallel with said first capacitor to interpose said voltage divider, a first diode through which the output voltage of the exhaust sensors is applied to the said first capacitor and said voltage divider and a second diode with the anode thereof connected to said second capacitor and the cathode thereof connected to the anode of said first diode, said voltage divider being adjusted such that the output voltage of said voltage divider is continuously in a definite proportion to the mean value of maximal and minimal values of the output voltage of the exhaust sensor, said output voltagge of said voltage divider being used as the reference voltage.

2. A reference voltage producing circuit as claimed in claim 1, wherein the exhaust sensor is an oxygen sensor of the concentration cell type having a metal oxide solid electrolyte.

3. A method of compensating for an inherent fluctuation of the output characteristic of an exhaust sensor which is installed in a exhaust line of an internal combustion engine as an element of a feedback control system for maintaining the air-fuel ratio of a combustible mixture fed to the engine at a predetermined ratio and producing an output voltage representing the concentration of a definite component of the exhaust gas of the engine, the concentration being in dependence on the air-fuel ratio of the combustion mixture consumed in the engine, the control system controlling the function of the air-fuel proportioning device based upon the magnitude of the deviation of the output voltage of the exhaust sensor from a reference voltage, the method comprising the steps of varying the reference voltage in response to and in a definite correlation with a change in a maximal value of the output voltage of the exhaust sensor, including continuously applying the output voltage of the exhaust sensor to a circuit comprising a maximal input retention circuit having a capacitor and a voltage divider as well as a minimal input retention circuit including said voltage divider and another capacitor, said voltage divider being adjusted such that the reference voltage is continuously in a definite proportion to the mean value of the maximal and minimal values of the output voltage of the exhaust sensor.

4. A method of compensating for an inherent fluctuation in the output characteristic of an exhaust sensor which is installed in an exhaust line of an internal combustion engine as an element of a feedback control system for maintaining the air-fuel ratio of a combustible mixture fed to the engine at a predetermined ratio and producing an output voltage representing the concentration of a definite component of the exhaust gas of the engine, the concentration being in dependence on the air-fuel ratio of the combustion mixture consumed in the engine, the control system controlling the function of the air-fuel proportioning device based upon the magnitude of a deviation of the output voltage of the exhaust sensor from a reference voltage, the method comprising the steps of varying the reference voltage in response to and in a definite correlation with a change in a maximal value of the output voltage of the exhaust sensor, including continuously applying the output voltage of the exhaust sensor to a maximal input retention circuit including a capacitor and a voltage divider adjusted such that the reference voltage is continuously in a definite proportion to a maximal value of the output voltage of an exhaust sensor, continuously producing an auxiliary and constant reference voltage which is below the maximum value of the output voltage of the maximal input retention circuit; using only the output voltage of the maximal input retention circuit as the reference voltage when the output of the maximal retention circuit is above the auxiliary reference voltage; and using only the auxiliary reference voltage as the reference voltage when the output of the maximal input retention circuit is below the auxiliary reference voltage.

5. In a feedback control system for maintaining the air-fuel ratio of a combustible mixture fed to an internal combustion engine, the system including an exhaust sensor which is installed in the exhaust line of the engine and produces an output voltage representing the concentration of a definite component of the exhaust gas of the engine, the concentration being in dependence on the air-fuel ratio of the combustible mixture consumed in the engine, a comparison circuit to detect the magnitude of a deviation of the output voltage of the exhaust sensor from a reference voltage and a control circuit to control the function of an air-fuel proportioning device based upon the detected magnitude of the deviation, a circuit for producing the reference signal comprising:

a first circuit having a capacitor connected to the exhaust sensor to continuously receive the output voltage of the exhaust sensor, and a voltage divider connected in parallel with said capacitor, said voltage divider being adjusted such that the output voltage of said voltage divider is continuously below and in a definite proportion to the maximal value of the output voltage of the exhaust sensor; and a second circuit having a resistor on which a constant voltage is continuously impressed such that said second circuit produces a constant output voltage below the maximum value of the output voltage of said first circuit, said second circuit being connected in parallel with said first circuit such that the magnitude of the reference voltage is the magnitude of the output voltage of said first circuit when the output voltage of said first circuit is above the output of the second circuit but otherwise is the magnitude of said second circuit, said output voltage of said voltage divider being used as the reference voltage.

6. A reference voltage producing circuit as claimed in claim 4, wherein the exhaust sensor is an oxygen sensor of the concentration cell type having a metal oxide electrolyte.

7. A method of compensating for an inherent fluctuation in the output characteristic of an exhaust sensor which is installed in an exhaust line of an internal combustion engine as an element of a feedback control system for maintaining the air-fuel ratio of a combustible mixture fed to the engine at a predetermined ratio and producing an output voltage representing the concentration of a definite component of the exhaust gas of the engine, the concentration being in dependence on the air-fuel ratio of the combustible mixture consumed in the engine, the control system controlling the function of an air-fuel proportioning device based upon the magnitude of a deviation of the output voltage of the exhaust sensor from a reference voltage, the method comprising the steps of varying the reference voltage in response to and in a definite correlation with a change in a maximal value of the output voltage of the exhaust sensor, including continuously applying the output voltage of the exhaust sensor to a maximal input retention circuit, including a capacitor and a voltage divider such that the reference voltage is continuously in a definite proportion to a maximal value of the output voltage of the exhaust sensor when the output voltage of the maximal input retention circuit is above a boundary voltage; and maintaining the reference voltage at the boundary voltage when the output voltage of the maximal input retention circuit is below the boundary voltage.

8. In a feedback control system for maintaining the air-fuel ratio of a combustible mixture fed to an internal combustion engine, the system including an exhaust sensor which is installed in the exhaust line of the engine and produces an output voltage representing the concentration of a definite component of the exhaust gas of the engine, the concentration being in dependence on the air-fuel ratio of the combustible mixture consumed in the engine, a comparison circuit to detect the magnitude of a deviation of the output voltage of the exhaust sensor from a reference voltage and a control circuit to control the function of an air-fuel proportioning device based upon the detected magnitude of the deviation, a circuit for producing the reference signal comprising:

a circuit having a capacitor connected to the exhaust sensor to continuously receive the output voltage of the exhaust sensor, and a voltage divider connected in parallel with said capacitor, and means for generating a lower boundary voltage, said voltage divider being adjusted such that the output voltage of said voltage divider is continuously below and in a definite proportion to the maximal value of the output voltage of the exhaust sensor when said maximal output voltage is above said boundary voltage and is maintained at said boundary voltage when said maximal sensor output voltage is below said boundary voltage.

* * * * *